US008465898B2

(12) United States Patent
Iwata et al.

(10) Patent No.: US 8,465,898 B2
(45) Date of Patent: Jun. 18, 2013

(54) FERRITE CARRIER CORE MATERIAL AND FERRITE CARRIER FOR ELECTROPHOTOGRAPHIC DEVELOPER, AND ELECTROPHOTOGRAPHIC DEVELOPER USING THE FERRITE CARRIER

(75) Inventors: Toru Iwata, Kashiwa (JP); Koji Aga, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 0 days.

(21) Appl. No.: 13/161,697

(22) Filed: Jun. 16, 2011

(65) Prior Publication Data

US 2012/0003579 A1 Jan. 5, 2012

(30) Foreign Application Priority Data

Jun. 30, 2010 (JP) ..... 2010-149106

(51) Int. Cl.
*G03G 9/00* (2006.01)

(52) U.S. Cl.
USPC ..... 430/111.31; 430/111.1; 430/111.3; 430/111.32; 420/70

(58) Field of Classification Search
USPC ..... 430/111.1, 111.3, 111.31, 111.32, 430/111.34, 111.35, 111.4; 420/70
See application file for complete search history.

(56) References Cited

U.S. PATENT DOCUMENTS

| | | | | |
|---|---|---|---|---|
| 7,862,975 | B2 | 1/2011 | Tabira et al. | |
| 7,879,522 | B2 | 2/2011 | Aga et al. | |
| 7,880,483 | B2 | 2/2011 | Aga et al. | |
| 2009/0197194 | A1* | 8/2009 | Aga et al. | 430/111.34 |
| 2009/0246670 | A1 | 10/2009 | Aga et al. | |
| 2009/0246676 | A1 | 10/2009 | Tabira et al. | |
| 2010/0111816 | A1 | 5/2010 | Aga et al. | |
| 2010/0196818 | A1* | 8/2010 | Kojima et al. | 430/111.32 |
| 2011/0013948 | A1 | 1/2011 | Aga et al. | |
| 2011/0129772 | A1 | 6/2011 | Iwata et al. | |
| 2011/0183253 | A1 | 7/2011 | Aga et al. | |
| 2011/0212399 | A1 | 9/2011 | Suwa et al. | |

FOREIGN PATENT DOCUMENTS

| | | |
|---|---|---|
| JP | 8-22150 | 1/1996 |
| JP | 2000-233930 | 8/2000 |
| JP | 2010-39368 | 2/2010 |

* cited by examiner

*Primary Examiner* — Mark F Huff
*Assistant Examiner* — Stewart Fraser
(74) *Attorney, Agent, or Firm* — Greenblum & Bernstein, P.L.C.

(57) ABSTRACT

There are provided a ferrite carrier core material for an electrophotographic developer, which contain 10 to 30% by weight of Mn, 1.0 to 3.0% by weight of Mg, 0.3 to 1.5% by weight of Ti and 40 to 60% by weight of Fe, a ferrite carrier for an electrophotographic developer obtained by coating the ferrite core material, and an electrophotographic developer using the ferrite carrier.

10 Claims, No Drawings

FERRITE CARRIER CORE MATERIAL AND FERRITE CARRIER FOR ELECTROPHOTOGRAPHIC DEVELOPER, AND ELECTROPHOTOGRAPHIC DEVELOPER USING THE FERRITE CARRIER

BACKGROUND OF THE INVENTION

1. Field of the Invention

The present invention relates to a ferrite carrier core material and a ferrite carrier used for a two-component electrophotographic developer used in copying machines, printers and the like, and an electrophotographic developer using the ferrite carrier.

2. Description of the Related Art

The method of electrophotographic development is a method in which toner particles in a developer are made to adhere on an electrostatic latent image formed on a photoreceptor to develop the image. The developer used in this method is classified into a two-component developer composed of a toner particle and a carrier particle, and a one-component developer using a toner particle alone.

As a development method using a two-component developer composed of a toner particle and a carrier particle among those developers, a cascade method and the like were formerly employed, but a magnetic brush method using a magnet roll is now in the mainstream.

In a two-component developer, a carrier particle is a carrier substance which is stirred with a toner particle in a development box filled with the developer to thereby impart a desired charge to the toner particle, and further transports the charged toner particle to a surface of a photoreceptor to thereby form a toner image on the photoreceptor. The carrier particle remaining on a development roll holding a magnet is again returned from the development roll to the development box, mixed and stirred with a fresh toner particle, and used repeatedly in a certain period.

In a two-component developer, unlike a one-component developer, a carrier particle has functions of being mixed and stirred with a toner particle to charge the toner particle and transporting the toner particle, and has good controllability on designing a developer. Therefore, the two-component developer is suitable for full-color development apparatuses requiring a high image quality, high-speed printing apparatuses requiring reliability and durability in image maintenance, and other apparatuses.

In a two-component developer thus used, it is needed that image characteristics, such as image density, fogging, white spots, gradation and resolving power, exhibit predetermined values from the initial stage, and additionally these characteristics do not vary and are stably maintained during endurance printing. In order to stably maintain these characteristics, properties of a carrier particle contained in a two-component developer need to be stable.

As a carrier particle forming a two-component developer, an iron powder carrier, such as an iron powder coated on the surface with an oxide film, or an iron powder coated on the surface with a resin, has conventionally been used. Since such an iron powder carrier has a high magnetization and a high electroconductivity as well, the carrier has an advantage of easily providing images well reproduced on the solid portion.

However, since such an iron powder carrier has a heavy true specific gravity of about 7.8 and a too high magnetization, stirring and mixing thereof with a toner particle in a development box is liable to generate fusion, so-called toner spent, of toner-constituting components onto the iron powder carrier surface. The generation of such toner spent decreases the effective carrier surface area, and is liable to reduce the triboelectric chargeability with the toner particle.

In a resin-coated iron powder carrier, the resin on the surface exfoliates due to stresses during endurance printing, and a core material (iron powder) having a high electroconductivity and a low dielectric breakdown voltage is thereby exposed, and leakage of the charge thereby occurs in some cases. Due to such leakage of the charge, an electrostatic latent image formed on a photoreceptor is broken, brush streaks and the like are generated on the solid portion, and a uniform image can hardly be obtained. For these reasons, iron powder carriers such as an oxide film-coated iron powder or a resin-coated iron powder have not been used recently.

In recent years, in place of an iron powder carrier, a ferrite having a light true specific gravity of about 5.0 and a low magnetization is sometimes used as a carrier, and a resin-coated ferrite carrier coated on the surface with a resin is often used, whereby the life of the developer has been remarkably prolonged.

The method for manufacturing such a ferrite carrier generally involves mixing ferrite carrier raw materials in predetermined amounts, and thereafter calcining, pulverizing and granulating and then sintering the mixed material; and depending on conditions, the calcination may be omitted.

Meanwhile, the environmental regulation has recently become strict, and the use of metals such as Ni, Cu and Zn comes to be avoided and the use of metals adapted to the environmental regulation is demanded; then, ferrite compositions used as a carrier core material have been shifted from Cu—Zn ferrites and Ni—Zn ferrites to manganese ferrites, Mn—Mg—Sr ferrites and the like, which use Mn.

Japanese Patent Laid-Open No. 08-22150 describes a ferrite carrier in which a part of a manganese-magnesium ferrite is replaced by SrO. It is contended that when the ferrite carrier is used as a developer with a toner, by reducing a variation in magnetization among ferrite carrier particles, the developer is excellent in image quality and durability, and friendly to the environment, and has a long life, and is excellent in environmental stability. However, the ferrite carrier described in Japanese Patent Laid-Open No. 08-22150 cannot satisfy simultaneously both a uniform surface property having a reasonable unevenness and a high charge imparting capability. If the sintering temperature is made high, since the surface property exhibits much of smooth portions and becomes non-uniform, not only the distributions of the resistance and the charge after resin coating are broadened, but also the strength to stirring stresses decreases. If the sintering temperature is made low, the surface apparently has a wrinkly uniform surface property, but since the value of the BET specific surface area becomes large, the charging property becomes low and the environmental difference becomes large.

Japanese Patent Laid-Open No. 2000-233930 discloses a carrier core composition containing manganese oxide and iron (III) oxide in certain proportions, containing titanium dioxide in a specific amount, and forming substantially a spinel phase material. The carrier core composition is contended to be environmentally safe and nonhazardous.

However, since the carrier core composition described in Japanese Patent Laid-Open No. 2000-233930 is a manganese ferrite, the composition has a low resistance, and a deterioration of image quality, such as the occurrence of fogging and a deterioration of gradation, are apprehended.

Carrier core materials using Mg are proposed as replacements of carrier core materials using Mn. For example, Japanese Patent Laid-Open No. 2010-39368 describes a carrier core material containing magnesium, titanium and iron in certain proportions and having a BET specific surface area in a specific range. It is contended that the carrier core material provides a desired resistance, a medium one or a high one, while exhibiting a high magnetization, and is excellent in the charging property, and has both of a surface property having a reasonable unevenness, and uniform shapes.

Since the carrier core material described in Japanese Patent Laid-Open No. 2010-39368 has low contents of manganese and titanium, the material basically exhibits properties of a magnetite, and since the magnetization of a low magnetic field side is low, the occurrence of carrier beads carry over in actual machine operations is apprehended.

In consideration of these conventional technologies, a ferrite carrier for an electrophotographic developer, which has a reasonable resistance and magnetization, and an excellent charging property, can maintain a high charge particularly at a high-temperature and high-humidity to thereby give a good environmental dependency, has been demanded.

Therefore, it is an object of the present invention to provide a ferrite carrier core material and a ferrite carrier for an electrophotographic developer, which have a reasonable resistance and magnetization, and an excellent charging property, and can maintain a high charge particularly at a high-temperature and high-humidity to thereby give a good environmental dependency, and an electrophotographic developer using the ferrite carrier.

SUMMARY OF THE INVENTION

As a result of exhaustive studies to solve the above-mentioned problems, the present inventors have found that a ferrite carrier core material containing certain amounts of Mn, Mg, Ti and Fe, and a ferrite carrier obtained by coating the ferrite carrier core material with a resin can achieve the above-mentioned object, and this finding has led to the present invention.

That is, the present invention provides a ferrite carrier core material for an electrophotographic developer, comprising 10 to 30% by weight of Mn, 1.0 to 3.0% by weight of Mg, 0.3 to 1.5% by weight of Ti and 40 to 60% by weight of Fe.

The ferrite carrier core material for an electrophotographic developer according to the present invention desirably has a magnetization of 45 to 70 $Am^2/kg$ at an impressed magnetic field of 0.5 $K \cdot 1000/4\pi$ A/m.

The ferrite carrier core material for an electrophotographic developer according to the present invention desirably has a volume resistance of $1\times10^6$ to $1\times10^{10}\Omega$ at a 2 mm-Gap impressed voltage of 50 V.

The ferrite carrier core material for an electrophotographic developer according to the present invention desirably has a BET specific surface area of 0.060 to 0.170 $m^2/g$.

The ferrite carrier core material for an electrophotographic developer according to the present invention desirably has a ratio of a charge amount in a low-temperature and low-humidity environment to a charge amount in a high-temperature and high-humidity environment of 0.85 to 1.15.

The ferrite carrier core material for an electrophotographic developer according to the present invention desirably comprises 0.1 to 1.0% of Sr.

The ferrite carrier core material for an electrophotographic developer according to the present invention desirably has an oxide film formed on a surface thereof.

The present invention provides a ferrite carrier for an electrophotographic developer, being obtained by coating a surface of the ferrite carrier core material described above with a resin.

The present invention provides an electrophotographic developer comprising the ferrite carrier described above and a toner.

The electrophotographic developer according to the present invention is used also as a refill developer.

The ferrite carrier core material for an electrophotographic developer according to the present invention has a reasonable resistance and magnetization, and an excellent charging property, and can maintain a high charge particularly at a high-temperature and high-humidity to thereby give a good environmental dependency. Then, an electrophotographic developer comprising a ferrite carrier obtained by coating the ferrite carrier core material described above with a resin, and a toner has a high charge amount, and is also excellent in the charging stability in every environment.

DETAILED DESCRIPTION OF THE EMBODIMENTS

Hereinafter, embodiments to carry out the present invention will be described.

<The Ferrite Carrier Core Material for an Electrophotographic Developer, and the Ferrite Carrier According to the Present Invention>

The carrier core material for an electrophotographic developer according to the present invention comprises 10 to 30% by weight, preferably 13 to 27% by weight and more preferably 14 to 25% by weight of Mn, 1.0 to 3.0% by weight, preferably 1.3 to 2.7% by weight and more preferably 1.5 to 2.5% by weight of Mg, 0.3 to 1.5% by weight, preferably 0.3 to 1.4% by weight and more preferably 0.45 to 1.4% by weight of Ti, and 40 to 60% by weight, preferably 42 to 58% by weight and more preferably 44 to 55% by weight of Fe. The balance is O and accompanying impurities; and the accompanying impurities are ones contained in raw materials and mingled in manufacture processes, and the total amount thereof is 0.5% by weight or less. The ferrite carrier core material in the above-mentioned compositional range has a high charge, and an excellent charging stability particularly at a high-temperature and high-humidity to thereby give a good environmental dependency.

Making Mn contained can raise the magnetization of the low magnetic field side, and can be anticipated to prevent the reoxidation of the core material when taken out from a furnace in regular sintering. The form of Mn when added is not especially limited, but is preferably $MnO_2$, $Mn_2O_3$, $Mn_3O_4$ and $MnCO_3$ because these can easily be available as industrial applications. With the content of Mn of less than 10% by weight, the magnetite component becomes much and not only since the magnetization of the low magnetic field side decreases, the carrier beads carry over occurs, but since the resistance is also low, a deterioration of the image quality occurs, such as the occurrence of fogging and a deterioration of gradation. If the content exceeds 30% by weight, since the resistance is high, the edge becomes too sharp, thereby reducing the image quality.

Making Mg contained can provide a developer constituted of a ferrite carrier and a full-color toner and good in charge rise, and can also raise the resistance. With the content of Mg of less than 1.0% by weight, since the resistance is low, a deterioration of the image quality occurs, such as the occurrence of fogging and a deterioration of gradation; and if the content exceeds 3.0% by weight, since the magnetization decreases, the carrier scattering occurs.

Not only Ti has the effect of decreasing the sintering temperature and can reduce agglomerated particles, but although the value of the BET specific surface area is low, a uniform wrinkly surface property can be obtained. The content of Ti of less than 0.3% by weight cannot provide the effect of containing Ti, and gives a high BET specific surface area and a low charge. If the content of Ti exceeds 1.5% by weight, since the magnetization becomes too low, desired magnetic properties cannot be provided.

With the content of Fe of less than 40% by weight, since the contents of Mg and/or Ti relatively increase, a non-magnetic component and/or a lowly magnetized component increases, which means that desired magnetic properties cannot be provided; and if the content exceeds 60% by weight, the effect of containing Mg and/or Ti cannot be provided, and the ferrite carrier core material becomes one substantially equivalent to a magnetite.

The carrier core material for an electrophotographic developer according to the present invention desirably comprises 0.1 to 1.0% by weight of Sr. Sr contributes to the regulation of the resistance and the surface property, and has also the effect of maintaining a high magnetization after surface oxidation. The case of Sr less than 0.1% by weight cannot provide the effect of containing Sr, and is liable to decrease the magnetization largely. Further since the effect that Sr moves to the core material particle surface in debindering and regular sintering cannot be obtained, the effect of raising the resistance and the charge amount of the core material cannot be anticipated. If the content of Sr exceeds 1.0% by weight, the residual magnetization and coercive force rise, and when the core material and coated carrier are made into a developer, image defects such as brush streaks occur and the image quality deteriorates.

(The Contents of Fe, Mn, Mg, Ti and Sr)

The contents of these Fe, Mn, Mg, Ti and Sr are measured as follows.

0.2 g of a ferrite carrier core material is weighed, added to a solution, in which 20 ml of 1N hydrochloric acid and 20 ml of 1N nitric acid are added to 60 ml of pure water, and heated to prepare an aqueous solution in which the ferrite carrier core material is completely dissolved; and the contents of Fe, Mn, Mg, Ti and Sr are measured using an ICP spectrometer (ICPS-1000IV), made by Shimadzu Corp.).

The ferrite carrier core material for an electrophotographic developer according to the present invention desirably has a magnetization of 45 to 70 $Am^2/kg$ at an impressed magnetic field of 0.5 K·1000/4π A/m. If the magnetization at the 0.5 K·1000/4π A/m is less than 45 $Am^2/g$, the magnetization of scattered materials deteriorates, which causes image defects due to carrier beads carry over; and if the magnetization exceeds 70 $Am^2/g$, the transportability of a toner when the core material is made into a developer is poor, which reduces the image quality. The residual magnetization is desirably 10 $Am^2/g$ or less. If the residual magnetization exceeds 10 $Am^2/g$, the fluidity of a developer in a development apparatus deteriorates, and the developer cannot sufficiently be stirred to impart a triboelectric charge to a toner. The coercive force of the composition according to the present invention is desirably 50 (3 K·1000/4π A/m) or less. If the coercive force exceeds 50 (3 K·1000/4π A/m), the fluidity of a developer in a development apparatus deteriorates, and the developer cannot sufficiently be stirred to impart a triboelectric charge to a toner. These magnetic properties (magnetization, residual magnetization and coercive force) are measured as follows.

(Magnetic Properties)

The magnetization properties are measured using an integration-type B-H tracer Model BHU-60 (made by Riken Denshi Co., Ltd.). An H coil for measuring a magnetic field and a 4πI coil for measuring a magnetization are placed between electromagnets. In this case, a sample is placed in the 4πI coil. The current of the electromagnets is varied to vary the magnetic field H, and outputs of the H coil and the 4πI coil are integrated, respectively; and a hysteresis loop is drawn on a recording paper with the H output on X axis and the output of the 4πI coil on Y axis. The measurement conditions are: a sample filling quantity is about 1 g; a sample filling cell has an inner diameter of 7 mmϕ±0.02 mm, a height of 10 mm±0.1 mm; and the 47πI coil has a winding number of 30.

The ferrite carrier core material for an electrophotographic developer according to the present invention desirably has a resistance of $1\times10^6$ to $1\times10^{10}\Omega$ at a 2 mm-Gap impressed voltage of 50 V. With the electric resistance of less than $1\times10^6\Omega$, the carrier scattering possibly may occur. If the electric resistance exceeds $1\times10^{10}\Omega$, since the resistance is too high, the edge becomes too sharp, thereby reducing the image quality, or the charge amount is liable to be charged up when the core material is made into a developer, which are not preferable. The electric resistance is measured as follows.

(The Electric Resistance)

Non-magnetic parallel flat plate electrodes (10 mm×40 mm) are opposed to each other with an electrode interval of 2.0 mm, and 200 mg of a sample is weighed and filled therebetween. Magnets (surface magnetic flux density: 1,500 Gauss, the area of the magnets brought into contact with the electrodes: 10 mm×30 mm) are attached to the parallel flat plate electrodes to hold the sample between the electrodes; and a voltage of 50 V is applied, and the resistance at an impressed voltage of 50 V is measured by an insulation resistance tester (SM-8210, made by DKK-TOA Corp.). The measurement is carried out in a thermo-hygrostat chamber controlled at a room temperature of 25° C. and a humidity of 55%.

The carrier core material for an electrophotographic developer according to the present invention has a BET specific surface area of 0.060 to 0.170 $m^2/g$, preferably 0.070 to 0.160 $m^2/g$, and more preferably 0.080 to 0.150 $m^2/g$. With the BET specific surface area of less than 0.060 $m^2/g$, since the unevenness of the core material surface is small, the anchor effect of a resin after resin coating cannot be obtained, and the core material strength to stirring stresses decreases. If the BET specific surface area exceeds 0.170 $m^2/g$, since the unevenness of the core material surface is large and a resin easily infiltrates, so a uniform resin coated film cannot be obtained, desired properties as a carrier for electrophotography cannot be provided. The BET specific surface area is measured as follows.

(BET Specific Surface Area)

The BET specific surface area can be determined from a $N_2$ adsorption amount of a carrier particle measured by making $N_2$ as an adsorption gas adsorbed thereon by using an automatic specific surface area analyzer "GEMINI 2360" (made by Shimadzu Corp.). Here, a measurement tube used in the measurement of the $N_2$ adsorption amount is baked under reduced pressure at 50° C. for 2 hours before the measurement. Then, 5 g of a ferrite carrier core material is filled in the measurement tube, and subjected to a pretreatment at a temperature of 30° C. for 2 hours, and thereafter, $N_2$ gas is made to be adsorbed at 25° C. and the adsorption amount is measured. The adsorption amount is a value obtained by drawing an adsorption isotherm and calculating from BET formula.

The ferrite carrier core material for an electrophotographic developer according to the present invention desirably has a ratio (an L/L charge amount/an H/H charge amount) of a charge amount in a low-temperature and low-humidity (L/L) environment to a charge amount in a high-temperature and high-humidity (H/H) environment of 0.85 to 1.15. With a ratio of less than 0.85, the environmental dependency is large and the image density in a high-temperature and high-humidity (H/H) environment when the core material and coated carrier are made into a developer is not sufficient. If the ratio exceeds 1.15, the image density in a low-temperature and low-humidity (L/L) environment when the core material is made into a developer is not sufficient. The charge amount is measured as follows.

(The Charge Amount)

A sample (a carrier or a carrier core material) and a commercially available negatively chargeable toner used in full-color printers and having an average particle diameter of about 6 μm are weighed so that the toner concentration is 6.5% by weight (the toner weight is 3.25 g, and the carrier weight is 46.75 g). The weighed carrier and toner are exposed to respective environments described later for 12 or more hours. Thereafter, the carrier and the toner are put in a 50-cc glass bottle, and stirred at a rotation frequency of 100 rpm for 30 min.

As a charge amount measuring apparatus, a magnet roll in which magnets (magnetic flux density: 0.1 T) of a total of 8 poles of N poles and S poles are alternately arranged on the inner side of an aluminum bare tube (hereinafter, sleeve) of a cylindrical shape of 31 mm in diameter and 76 mm in length, and a cylindrical electrode arranged in the outer circumference of the sleeve with a gap of 5.0 mm to the sleeve, are arranged.

0.5 g of a developer is uniformly adhered on the sleeve, and thereafter, while the magnet roll, which is on the inner side, is being rotated at 100 rpm with the outer-side aluminum bare tube being fixed, a direct current voltage of 2,000 V is applied for 60 sec between the outer electrode and the sleeve to transfer the toner to the outer-side electrode. At this time, an electrometer (an insulation-resistance tester, model: 6517A, made by Keithley Instrument Inc.) is connected to the cylindrical electrodes to measure the charge amount of the transferred toner.

After the elapse of 60 sec, the impressed voltage is shut off, and after the rotation of the magnet roll is stopped, the outer-side electrode is taken out and the weight of the toner having transferred to the electrode is measured.

The charge amount is calculated from the measured charge amount and the weight of the transferred toner.

Here, the respective environmental conditions are as follows.

The normal-temperature and normal-humidity (N/N environment): a temperature of 20 to 25° C. and a relative humidity of 50 to 60%

The high-temperature and high-humidity (H/H environment): a temperature of 30 to 35° C. and a relative humidity of 80 to 85%

The low-temperature and low-humidity (L/L environment): a temperature of 10 to 15° C. and a relative humidity of 10 to 15%

The carrier core material for an electrophotographic developer according to the present invention has an volume-average particle diameter, as measured by a laser diffraction-type particle size distribution measuring device, of preferably 15 to 120 μm, more preferably 15 to 80 μm, and most preferably 15 to 60 μm. If the volume-average particle diameter is less than 15 μm, the carrier beads carry over is liable to occur, which is not preferable. If the volume-average particle diameter exceeds 120 μm, the image quality is liable to deteriorate, which is not preferable. The volume-average particle diameter is measured as follows.

(The Volume-Average Particle Diameter)

As a measuring device, a MicroTrack particle size analyzer (Model: 9320-X100), made by Nikkiso Co., Ltd. is used. As a dispersion medium, water is used.

The carrier core material for an electrophotographic developer according to the present invention desirably has the surface having been subjected to an oxidation treatment. The thickness of the oxidatively treated film formed by the surface oxidation treatment is preferably 0.1 nm to 5 μm. If the thickness of the film is less than 0.1 nm, the effect of the oxide film layer is small; and if the thickness of the film exceeds 5 μm, since the magnetization obviously decreases and the resistance becomes too high, trouble such as a decrease in the developability is liable to occur. As required, reduction may be carried out before the oxidation treatment. The thickness of an oxide film can be measured directly from a SEM photograph of such a high magnification that an oxide film being formed can be confirmed. The presence/absence of an oxidatively treated film may be known indirectly from a change in the resistances before and after the surface oxidation treatment. The oxide film may be formed uniformly on the core material surface, or may be formed partially thereon.

In the carrier for an electrophotographic developer according to the present invention, a surface of the carrier core material is coated with a resin.

The resin-coated carrier for an electrophotographic developer according to the present invention desirably has a resin coating amount of 0.1 to 10% by weight with respect to the carrier core material. With the coating amount of less than 0.1% by weight, it is difficult to form a uniform coating layer on the carrier surface; and if the coating amount exceeds 10% by weight, agglomeration of carrier particles comes to occur, thereby causing a decrease in productivity such as a decrease in yield, and also variations in properties of a developer, such as the fluidity or the charge amount, in actual machines.

The film forming resin used here can suitably be selected depending on a toner combined and the environment used and the like. The kind thereof is not especially limited, but examples thereof include fluororesins, acrylic resins, epoxy resins, polyamide resins, polyamide imide resins, polyester resins, unsaturated polyester resins, urea resins, melamine resins, alkyd resins, phenol resins, fluoroacrylic resins, acrylstyrene resins, silicone resins, and modified silicone resins modified with a resin such as acrylic resins, polyester resins, epoxy resins, polyamide resins, polyamide imide resins, alkyd resins, urethane resins and fluororesins. More preferably used in the present invention is an acrylic resin, a silicone resin or a modified silicone resin.

In order to control the electric resistivity, the charge amount and the charging rate of a carrier, a film forming resin may contain an electroconductive agent. Since an electroconductive agent itself has a low electric resistance, a too much content thereof is liable to cause rapid charge leakage. Therefore, the content thereof is 0.25 to 20.0% by weight, preferably 0.5 to 15.0% by weight, and especially preferably 1.0 to 10.0% by weight, with respect to a solid content of the film forming resin. The electroconductive agent includes electroconductive carbon, oxides such as titanium oxide and tin oxide, and various types of organic electroconductive agents.

The film forming resin may contain a charge control agent. Examples of the charge control agent include various types of charge control agents commonly used for toners, and various types of silane coupling agents. This is because, in the case where the exposed core material area is controlled so as to become relatively small by the film formation, the charge imparting capability decreases in some cases, but addition of various types of charge control agents and silane coupling agents can control the charge imparting capability. The type of charge control agents and coupling agents usable is not especially limited, but is preferably a charge control agent such as nigrosine dyes, quaternary ammonium salts, organic metal complexes or metal-containing monoazo dyes, and an aminosilane coupling agent, a fluorine-based silane coupling agent or the like. The measuring method of the charge amount is as described above.

<Manufacturing Methods of the Carrier Core Material and the Carrier for an Electrophotographic Developer According to the Present Invention>

Then, manufacturing methods of the carrier core material and the carrier for an electrophotographic developer according to the present invention will be described.

The manufacturing method of the carrier core material for an electrophotographic developer according to the present invention involves pulverizing each of compounds of Fe, Mn, Mg and Ti, and as required, Sr, and mixing and calcining them, and thereafter, again pulverizing, mixing and granulating the calcined material, and debindering and regularly sintering the obtained granulated material, and further deagglomerating and classifying the sintered material, and as required, subjecting the classified material to a surface oxidation treatment.

The method of pulverizing each of compounds of Fe, Mn, Mg and Ti, and as required, Sr, and mixing and calcining them, and thereafter, again pulverizing, mixing and granulating the calcined material to prepare a granulated material is not especially limited, and conventionally well-known methods can be employed, and a dry-type method or a wet-type method may be used. For example, $Fe_2O_3$, $TiO_2$, $Mg(OH)_2$ and/or $MgCO_3$, $SrCO_3$, and $Mn_3O_4$ as raw materials are mixed, and calcined in the atmosphere. After the calcination, the obtained calcined material is further pulverized by a ball mill, a vibration mill or the like; thereafter, water and as required, a dispersant, a binder and the like are added thereto; and after viscosity regulation, the mixture is granulated by a spray drier. In the pulverization after the calcination, the pulverization may be carried out by adding water and using a wet-type ball mill, a wet-type vibration mill or the like. As the binder, use of polyvinyl alcohol or polyvinyl pyrrolidone is preferable. This calcination may not necessarily be carried out in the case where desired properties are to be obtained.

In the manufacturing method according to the present invention, after the obtained granulated material is debindered, a regular sintering is carried out. Here, the debindering is carried out at 500 to 1,000° C.; and the regular sintering is carried out in an inert atmosphere, for example, in a nitrogen atmosphere, at 1,100 to 1,220° C.

Thereafter, the obtained sintered material is recovered, dried and classified to obtain a carrier core material (ferrite particle). The sintered material is size-regulated to a desired particle diameter using a classification method such as an existing air classification, mesh filtration or precipitation method. In the case of carrying out dry-type recovering, the recovering may be carried out by a cyclone or the like.

Thereafter, as required, the surface is subjected to an oxide film formation by low-temperature heating to regulate the electric resistivity. The oxide film formation uses a common rotary electric furnace, batch type electric furnace or the like, and involves, for example, a thermal treatment at 600° C. or lower. In order to form an oxide film uniformly on a core material particle, use of a rotary electric furnace is preferable.

In the ferrite carrier for an electrophotographic developer according to the present invention, a surface of the ferrite carrier core material is coated with a resin described above to form a resin film. The coating can be carried out by a well-known coating method, for example, a brush coating method, a spray dry system using a fluidized bed, a rotary dry system, a dip-and-dry method using a universal stirrer, or the like. In order to improve the surface coverage, the method using a fluidized bed is preferable.

In the case where after a resin is coated on a ferrite carrier core material, baking is carried out, the baking may be carried out using either of an external heating system and an internal heating system, for example, a fixed or fluidized electric furnace, a rotary electric furnace, a burner furnace or a microwave system. In the case of using a UV curing resin, a UV heater is used. The baking temperature is different depending on a resin to be used, but needs to be a temperature equal to or higher than the melting point or the glass transition point; and for a thermosetting resin, a condensation-crosslinking resin or the like, the temperature needs to be raised to a temperature at which the curing progresses fully.

<The Electrophotographic Developer According to the Present Invention>

Then, the electrophotographic developer according to the present invention will be described.

The electrophotographic developer according to the present invention comprises the above-mentioned ferrite carrier for an electrophotographic developer, and a toner.

A toner particle constituting the electrophotographic developer according to the present invention includes a pulverized toner particle produced by a pulverizing method and a polymerized toner particle produced by a polymerizing method. In the present invention, the toner particles obtained by either of the methods can be used.

The pulverized toner particle can be obtained by sufficiently mixing, for example, a binding resin, a charge control agent and a colorant by a mixer such as a Henschel mixer, then melting and kneading the mixture by a twin-screw extruder or the like, cooling, then pulverizing and classifying the extruded material, and adding external additives to the classified material, and then mixing the mixture by a mixer or the like.

The binding resin constituting the pulverized toner particle is not especially limited, but includes polystyrene, chloropolystyrene, styrene-chlorostyrene copolymers, styrene-acrylate copolymers, styrene-methacrylic acid copolymers, and additionally rosin-modified maleic resins, epoxy resins, polyester resins and polyurethane resins. These are used singly or as a mixture thereof.

The charge control agent usable is an optional one. Examples of a positively chargeable toner include nigrosine dyes and quaternary ammonium salts; and examples of a negatively chargeable toner include metal-containing monoazo dyes.

The colorant (coloring agent) usable is a conventionally known dye and pigment. For example, usable are carbon black, phthalocyanine blue, Permanent Red, chrome yellow, phthalocyanine green and the like. Besides, external additives, such as silica powder and titania, to improve the fluidity and agglomeration resistance of a toner may be added depending on the toner particle.

The polymerized toner particle is a toner particle produced by a well-known method such as a suspension polymerization method, an emulsion polymerization method, an emulsion agglomeration method, an ester extension polymerization method or a phase transition emulsion method. Such a polymerized toner particle is obtained, for example, by mixing and stirring a colored dispersion liquid in which a colorant is dispersed in water using a surfactant, a polymerizable monomer, a surfactant and a polymerization initiator in an aqueous medium to emulsify and disperse and polymerize the polymerizable monomer in the aqueous medium under stirring and mixing, thereafter adding a salting-out agent to salt out a polymer particle. A polymerized toner particle can be obtained by filtering, washing and drying the particle obtained by the salting-out. Thereafter, as required, external additives are added to the dried toner particle for functionalization.

When the polymerized toner particle is produced, in addition to the polymerizable monomer, the surfactant, the polymerization initiator and the colorant, a fixation improving agent and a charge control agent may be further blended, whereby various properties of a polymerized toner particle thus obtained can be controlled and improved. In order to improve the dispersibility of the polymerizable monomer in the aqueous medium, and regulate the molecular weight of a polymer obtained, a chain transfer agent may be further used.

The polymerizable monomer used for production of the polymerized toner particle is not especially limited, but examples of the monomers include styrene and its derivatives, ethylenic unsaturated monoolefins such as ethylene and propylene, halogenated vinyls such as vinyl chloride, vinyl esters such as vinyl acetate, and α-methylene aliphatic monocarboxylate esters such as methyl acrylate, ethyl acrylate, methyl methacrylate, ethyl methacrylate, 2-ethylhexyl methacrylate, acrylic acid dimethyl amino ester and methacrylic acid diethyl amino ester.

The colorant (coloring material) usable in preparation of the polymerized toner particle is a conventionally known dye and pigment. For example, usable are carbon black, phthalocyanine blue, Permanent Red, chrome yellow, phthalocyanine green and the like. These colorants may be modified on their surface using a silane coupling agent, a titanium coupling agent or the like.

The surfactant usable in production of the polymerized toner particle is an anionic surfactant, a cationic surfactant, an amphoteric surfactant and a nonionic surfactant.

Here, the anionic surfactant includes fatty acid salts such as sodium oleate and castor oil, alkylsulfate esters such as sodium laurylsulfate and ammonium laurylsulfate, alkylbenzenesulfonate salts such as sodium dodecylbenzenesulfonate, alkylnaphthalenesulfonates, alkylphosphate salts, naphthalenesulfonic acid-formalin condensates and polyoxyethylene alkylsulfate salts. The nonionic surfactant includes polyoxyethylene alkyl ethers, polyoxyethylene fatty acid esters, sorbitan fatty acid esters, polyoxyethylene alkylamines, glycerol, fatty acid esters and oxyethylene-oxypropylene block polymers. Furthermore, the cationic surfactant includes alkylamine salts such as laurylamine acetate, and quaternary ammonium salts such as lauryltrimethylammonium chloride and stearyltrimethylammonium chloride. Then, the amphoteric surfactant includes aminocarboxylate salts and alkylamino acids.

A surfactant as described above can be used usually in an amount in the range of 0.01 to 10% by weight with respect to a polymerizable monomer. Such a surfactant influences the dispersion stability of a monomer, and influences also the environmental dependency of a polymerized toner particle obtained. The use thereof in the range described above is preferable from the viewpoint of securing the dispersion stability of the monomer and reducing the environmental dependency of the polymerized toner particle.

For production of a polymerized toner particle, a polymerization initiator is usually used. The polymerization initiator includes a water-soluble polymerization initiator and an oil-soluble polymerization initiator. In the present invention, either of them can be used. Examples of the water-soluble polymerization initiators usable in the present invention include persulfate salts such as potassium persulfate and ammonium persulfate, and water-soluble peroxide compounds. Examples of the oil-soluble polymerization initiators include azo compounds such as azobisisobutyronitrile, and oil-soluble peroxide compounds.

In the case of using a chain transfer agent in the present invention, examples of the chain transfer agents include mercaptans such as octylmercaptan, dodecylmercaptan and tert-dodecylmercaptan, and carbon tetrabromide.

Further in the case where a polymerized toner particle used in the present invention comprises a fixability improving agent, the fixability improving agent usable is natural waxes such as carnauba wax, and olefinic waxes such as polypropylene and polyethylene.

In the case where the polymerized toner particle used in the present invention comprises a charge control agent, the charge control agent to be used is not especially limited, and usable are nigrosine dyes, quaternary ammonium salts, organic metal complexes, metal-containing monoazo dyes, and the like.

External additives to be used for improving the fluidity and the like of a polymerized toner particle include silica, titanium oxide, barium titanate, fluororesin microparticles and acrylic resin microparticles. These may be used singly or in combination thereof.

The salting-out agent to be used for separation of a polymerized particle from an aqueous medium includes metal salts such as magnesium sulfate, aluminum sulfate, barium chloride, magnesium chloride, calcium chloride and sodium chloride.

The toner particle produced as described above has a volume-average particle diameter in the range of 2 to 15 μm, and preferably 3 to 10 μm, and the polymerized toner particle has a higher uniformity of particles than the pulverized toner particle. If the toner particle is less than 2 μm, the chargeability decreases and fogging and toner scattering are liable to be caused; and the toner particle exceeding 15 μm causes a deterioration of the image quality.

The carrier and the toner produced as described above are mixed to obtain an electrophotographic developer. The mixing ratio of the carrier and the toner, that is, the toner concentration is preferably set at 3 to 15% by weight. The toner concentration less than 3% by weight hardly provide a desired image density; and the toner concentration exceeding 15% by weight is liable to generate toner scattering and fogging.

The electrophotographic developer according to the present invention may be used as a refill developer. In this case, the mixing ratio of the carrier and the toner, that is, the preferable minimum toner concentration is 3.3% by weight and the preferable maximum toner concentration is 100% by weight, wherein Toner Concentration is ([Toner Weight]/[{Toner Weight}+{Carrier Weight}])×100).

The electrophotographic developer according to the present invention, prepared as described above, can be used in copying machines, printers, FAXs, printing machines and the like, which use a digital system using a development system in which electrostatic latent images formed on a latent image holder having an organic photoconductive layer are reversely developed with a magnetic brush of a two-component developer having a toner and a carrier while a bias electric field is being impressed. The electrophotographic developer is also applicable to full-color machines and the like using an alternative electric field, in which when a development bias is impressed from a magnetic brush to an electrostatic latent image side, an AC bias is superimposed on a DC bias.

Hereinafter, the present invention will be described specifically by way of Examples and the like.

Example 1

$Fe_2O_3$, $Mg(OH)_2$, Ti $O_2$, $Mn_3O_4$ and $SrCO_3$ were weighed so that Mn was 40 mol, Mg was 10 mol, Fe was 100 mol, Ti was 1 mol, and Sr was 0.8 mol, and pelletized by a roller compactor. The obtained pellet was calcined in a rotary at 950° C. sintering furnace.

The calcined pellet was pulverized by a wet-type ball mill for 7 hours; PVA as a binder component was added to the slurry so that the amount of PVA became 3.2% by weight to the slurry solid content; and a polycarboxylic acid-based dispersant was added thereto so that the viscosity of the slurry became 2 to 3 poises. $D_{50}$ of the slurry particle diameter at this time was 2.3 μm.

The pulverized slurry thus obtained was granulated and dried by a spray drier, debindered in the atmosphere at 650° C. using an electric furnace, and held in a nitrogen atmosphere at 1,150° C. for 4 hours using an electric furnace to carry out regular sintering. Thereafter, the sintered material was agglomerated, and further classified to obtain a carrier core material composed of a ferrite particle.

Further, the carrier core material composed of a ferrite particle was subjected to a surface oxidation treatment at a surface oxidation treatment temperature of 540° C. under the condition of the atmosphere using a rotary electric furnace to obtain a surface-oxidized carrier core material (ferrite particle).

Example 2

A carrier core material (ferrite particle) was obtained as in Example 1, except for that $TiO_2$ was added so that the addition amount of Ti was 2 mol, and no surface oxidation treatment was carried out.

Example 3

A carrier core material (ferrite particle) was obtained as in Example 1, except for that $TiO_2$ was added so that the addition amount of Ti was 2 mol.

Example 4

A carrier core material (ferrite particle) was obtained as in Example 1, except for that $TiO_2$ was added so that the addition amount of Ti was 3 mol.

Example 5

A carrier core material (ferrite particle) was obtained as in Example 3, except for that the regular sintering temperature was 1,080° C.

Example 6

A carrier core material (ferrite particle) was obtained as in Example 3, except for that the regular sintering temperature was 1,100° C.

Example 7

A carrier core material (ferrite particle) was obtained as in Example 3, except for that the regular sintering temperature was 1,210° C.

Example 8

A carrier core material (ferrite particle) was obtained as in Example 3, except for that the regular sintering temperature was 1,230° C.

Example 9

A carrier core material (ferrite particle) was obtained as in Example 3, except for that the surface oxidation treatment temperature was 500° C.

Example 10

A carrier core material (ferrite particle) was obtained as in Example 3, except for that the surface oxidation treatment temperature was 600° C.

Example 11

A carrier core material (ferrite particle) was obtained as in Example 3, except for that $Mg(OH)_2$ was added so that the addition amount of Mg was 7 mol.

Example 12

A carrier core material (ferrite particle) was obtained as in Example 3, except for that $Mg(OH)_2$ was added so that the addition amount of Mg was 13 mol.

Example 13

A carrier core material (ferrite particle) was obtained as in Example 3, except for that $Mn_3O_4$ was added so that the addition amount of Mn was 30 mol.

Example 14

A carrier core material (ferrite particle) was obtained as in Example 3, except for that $Mn_3O_4$ was added so that the addition amount of Mn was 60 mol.

Example 15

A carrier core material (ferrite particle) was obtained as in Example 3, except for that no $SrCO_3$ was added.

Comparative Example 1

A carrier core material (ferrite particle) was obtained as in Example 3, except for that no $TiO_2$ was added.

Comparative Example 2

A carrier core material (ferrite particle) was obtained as in Example 3, except for that no $TiO_2$ was added, and the regular sintering temperature was 1,210° C.

Comparative Example 3

A carrier core material (ferrite particle) was obtained as in Example 3, except for that $TiO_2$ was added so that the addition amount of Ti was 4 mol.

Comparative Example 4

A carrier core material (ferrite particle) was obtained as in Example 3, except for that $Mg(OH)_2$ was added so that the addition amount of Mg was 15 mol.

Comparative Example 5

A carrier core material (ferrite particle) was obtained as in Example 3, except for that $Mn_3O_4$ was added so that the addition amount of Mn was 80 mol.

Comparative Example 6

An amorphous carrier core material (ferrite particle) was obtained by the method described in Japanese Patent Laid-Open No. 2000-233930. That is, $Fe_2O_3$, $TiO_2$ and $Mn_3O_4$ were added so that Fe was 100 mol, Ti was 0.125 mol, and Mn was 25 mol; and 0.2% by weight of carbon black was further added and mixed in a mixer having high-speed stirring blades; and the mixture was granulated by a pressurized molding machine, and thereafter, the granulate was calcined in a rotary sintering furnace at 950° C. The calcined material was pulverized by a roll-type pulverizer, and thereafter size-regulated using an air classifier and a vibrating screen. The size-regulated material was not subjected to debindering and regular granulation, and was subjected to regular sintering in an atmosphere of an oxygen concentration of 0.1% by volume at 1,300° C. Thereafter, the sintered material was agglomerated, and further classified to obtain an amorphous carrier core material (ferrite particle). The surface oxidation treatment was not carried out.

Comparative Example 7

$Mg(OH)_2$, $TiO_2$, $Mn_3O_4$ and $SrCO_3$ were added so that the addition amount of Ti was 2.25 mol, the addition amount of Mg was 6 mol, the addition amount of Sr was 0.9 mol, and the addition amount of Mn was 6 mol; and 0.5% by weight of an active carbon was further added, and pelletized by a roller compactor; and thereafter, the pelletized material was calcined in a nitrogen gas atmosphere at 1,000° C. After regular granulation, the granulated material was subjected to debindering in a nitrogen gas atmosphere at 800° C., to regular sintering in a nitrogen gas atmosphere at 1,200° C., and to a surface oxidation treatment at a temperature of 630° C. Except for these conditions, a carrier core material (ferrite particle) was obtained as in Example 3.

The formulation proportions, the slurry particle diameters in the regular granulation, the debindering conditions and the regular sintering conditions of Examples 1 to 15 and Comparative Examples 1 to 7 are shown in Table 1. The magnetizations (B-H at 0.5 K·1000/4π, B-H at 3 K·1000/4π), the BET specific surface areas, and the shape factors SF-2, before the surface oxidation treatment, are shown in Table 2.

The surface oxidation treatment temperatures, the magnetizations (B-H at 0.5 K·1000/4π, B-H at 3 K·1000/4π), the residual magnetizations, the coercive forces, the volume-average particle diameters, the apparent densities, and the BET specific surface areas, after the surface oxidation treatment, of Examples 1 to 15 and Comparative Examples 1 to 7 are shown in Table 3. The charging properties (the charge amount in each environment, and the ratio of the L/L charge amount and the H/H charge amount), the resistivities (2 mm-Gap), and the chemical analyses (ICP), after the surface oxidation treatment, of Examples 1 to 15 and Comparative Examples 1 to 7 are shown in Table 4. Provided that in Table 3 and Table 4, since Example 2 and Comparative Example 6 did not carry out the surface oxidation treatment, the results with no surface oxidation treatment are shown.

In Table 2 to Table 4, the measurement methods of the magnetic properties (magnetization, residual magnetization and coercive force), the volume-average particle diameters, the BET specific surface areas, the charging properties (the charge amount in each environment), the resistivities (2 mm-Gap), and the chemical analyses (ICP) were as described before. The measurement methods of the apparent density and the shape factor SF-2 were as follows.

(The Apparent Density)

The apparent density was measured according to JIS-Z2504 (Metallic powders—Determination of apparent density—Funnel method).

(The Shape Factor SF-2 (Roundness))

The shape factor SF-2 is a numerical value obtained by dividing the square of a projected peripheral length of a carrier by a projected area of the carrier, dividing the quotient by 4π, and multiplying the quotient by 100; and the shape factor SF-2 of a carrier whose shape is nearer a sphere has a value nearer 100. The shape factor SF-2 (roundness) was measured as follows.

3,000 core material particles were observed using a particle size/shape distribution analyzer PITA-1, made by Seishin Enterprise Co., Ltd.; S (projected area) and L (projected peripheral length) were determined using software ImageAnalysis, attached to the analyzer, to obtain a shape factor SF-2 from the formula shown below. The shape factor SF-2 of a carrier whose shape is nearer a sphere has a value nearer 100. In the case of a carrier core material having a shape factor SF-2 of less than 110, since unevenness of the core material surface is small, the anchor effect of a resin after resin coating cannot be obtained and the resin film is liable to exfoliate, thereby providing a carrier for electrophotography inferior in the durability. If SF-2 exceeds 120, since that means that there is large unevenness of a resin on the core material surface, and the resin easily infiltrate, desired properties as a carrier for electrophotography possibly may not be obtained.

A sample liquid used was prepared by dispersing 0.1 g of a core material particle in 30 cc of a xanthan gum aqueous solution having a viscosity of 0.5 Pa·s prepared as a dispersion medium. By properly adjusting the viscosity of the dispersion medium in such a way, the core material particle could be held in the state of being dispersed in the dispersion medium, and the measurement could be carried out smoothly. The measurement conditions used were: the magnification of an (objective) lens was 10×; the filter was ND4×2; the carrier liquid 1 and the carrier liquid 2 used a xanthan gum aqueous solution having a viscosity of 0.5 Pa·s; and the flow rates were each 10 μl/sec; and the sample liquid flow rate was 0.08 μl/sec.

The carrier core material for an electrophotographic developer according to the present invention desirably has a shape factor SF-2 (roundness) of 110 to 120.

$$SF\text{-}2=L^2/S/4\pi\times100$$

(L represents a projected peripheral length, and S represents a projected area)

TABLE 1

| | Formulation (Charging mol) | | | | | Regular Granulation | Debindering | | Regular Sintering | |
|---|---|---|---|---|---|---|---|---|---|---|
| | Fe | Ti | Mg | Sr | Mn | Slurry Particle Diameter (μm) | Treatment Temperature (° C.) | Baking Atmosphere (Oxygen Concentration vol %) | Sintering Temperature (° C.) | Sintering Atmosphere (Oxygen Concentration vol %) |
| Example 1 | 100 | 1 | 10 | 0.8 | 40 | 2.3 | 650 | 21 (the atmosphere) | 1150 | 0 |
| Example 2 | 100 | 2 | 10 | 0.8 | 40 | 2.3 | 650 | 21 (the atmosphere) | 1150 | 0 |
| Example 3 | 100 | 2 | 10 | 0.8 | 40 | 2.3 | 650 | 21 (the atmosphere) | 1150 | 0 |
| Example 4 | 100 | 3 | 10 | 0.8 | 40 | 2.5 | 650 | 21 (the atmosphere) | 1150 | 0 |
| Example 5 | 100 | 2 | 10 | 0.8 | 40 | 2.3 | 650 | 21 (the atmosphere) | 1080 | 0 |
| Example 6 | 100 | 2 | 10 | 0.8 | 40 | 2.3 | 650 | 21 (the atmosphere) | 1100 | 0 |
| Example 7 | 100 | 2 | 10 | 0.8 | 40 | 2.0 | 650 | 21 (the atmosphere) | 1210 | 0 |
| Example 8 | 100 | 2 | 10 | 0.8 | 40 | 2.0 | 650 | 21 (the atmosphere) | 1230 | 0 |
| Example 9 | 100 | 2 | 10 | 0.8 | 40 | 2.3 | 650 | 21 (the atmosphere) | 1150 | 0 |
| Example 10 | 100 | 2 | 10 | 0.8 | 40 | 2.3 | 650 | 21 (the atmosphere) | 1150 | 0 |
| Example 11 | 100 | 2 | 7 | 0.8 | 40 | 2.0 | 650 | 21 (the atmosphere) | 1150 | 0 |
| Example 12 | 100 | 2 | 13 | 0.8 | 40 | 2.1 | 650 | 21 (the atmosphere) | 1150 | 0 |
| Example 13 | 100 | 2 | 10 | 0.8 | 30 | 2.2 | 650 | 21 (the atmosphere) | 1150 | 0 |
| Example 14 | 100 | 2 | 10 | 0.8 | 60 | 2.1 | 650 | 21 (the atmosphere) | 1150 | 0 |
| Example 15 | 100 | 2 | 10 | 0 | 40 | 2.0 | 650 | 21 (the atmosphere) | 1150 | 0 |
| Comparative Example 1 | 100 | 0 | 10 | 0.8 | 40 | 1.4 | 650 | 21 (the atmosphere) | 1150 | 0 |
| Comparative Example 2 | 100 | 0 | 10 | 0.8 | 40 | 1.4 | 650 | 21 (the atmosphere) | 1210 | 0 |
| Comparative Example 3 | 100 | 4 | 10 | 0.8 | 40 | 2.1 | 650 | 21 (the atmosphere) | 1150 | 0 |
| Comparative Example 4 | 100 | 2 | 15 | 0.8 | 40 | 2.2 | 650 | 21 (the atmosphere) | 1150 | 0 |
| Comparative Example 5 | 100 | 2 | 10 | 0.8 | 80 | 2.1 | 650 | 21 (the atmosphere) | 1150 | 0 |
| Comparative Example 6 | 100 | 0.13 | 0 | 0 | 25 | no granulation and no debindering because of being amorphous | | | 1300 | 0.1 |
| Comparative Example 7 | 100 | 2.25 | 6 | 0.9 | 6 | 2.5 | 800 | 0 | 1200 | 0 |

TABLE 2

| | Saturation Magnetization (B—H@0.5k · 1000/4π) | Saturation Magnetization (B—H@3k · 1000/4π) | BET Specific Surface Area ($m^2/g$) | Shape Factor SF-2 |
|---|---|---|---|---|
| Example 1 | 60 | 73 | 0.138 | 113.8 |
| Example 2 | 57 | 70 | 0.084 | 112.4 |
| Example 3 | 57 | 70 | 0.084 | 112.4 |
| Example 4 | 57 | 68 | 0.081 | 113.2 |
| Example 5 | 45 | 60 | 0.185 | 121.0 |
| Example 6 | 54 | 69 | 0.114 | 113.2 |
| Example 7 | 60 | 71 | 0.075 | 116.2 |
| Example 8 | 60 | 71 | 0.057 | 117.1 |
| Example 9 | 57 | 70 | 0.084 | 112.4 |
| Example 10 | 57 | 70 | 0.084 | 113.0 |
| Example 11 | 63 | 75 | 0.083 | 112.4 |
| Example 12 | 46 | 60 | 0.088 | 113.0 |
| Example 13 | 52 | 68 | 0.113 | 113.4 |
| Example 14 | 62 | 73 | 0.082 | 112.6 |
| Example 15 | 56 | 69 | 0.081 | 112.6 |

TABLE 2-continued

| | Saturation Magnetization (B—H@0.5k · 1000/4π) | Saturation Magnetization (B—H@3k · 1000/4π) | BET Specific Surface Area ($m^2/g$) | Shape Factor SF-2 |
|---|---|---|---|---|
| Comparative Example 1 | 57 | 75 | 0.177 | 112.1 |
| Comparative Example 2 | 63 | 77 | 0.069 | 109.8 |
| Comparative Example 3 | 45 | 60 | 0.079 | 111.9 |
| Comparative Example 4 | 42 | 55 | 0.095 | 113.6 |
| Comparative Example 5 | 64 | 75 | 0.078 | 112.6 |
| Comparative Example 6 | 63 | 94 | 0.020 | 151.3 |
| Comparative Example 7 | 50 | 70 | 0.086 | 114.9 |

TABLE 3

| | Surface Oxidation | Saturation Magnetization | | Volume-Average | | | | |
|---|---|---|---|---|---|---|---|---|
| | Treatment Temperature (° C.) | (B—H@0.5k · 1000/4π) (Am2/kg) | (B—H@3k · 1000/4π) (Am2/kg) | Residual Magnetization ($Am^2/kg$) | Coercive Force (1000/4π · A/m) | Particle Diameter (μm) | Apparent Density ($g/cm^3$) | BET Specific Surface Area ($m^2/g$) |
| Example 1 | 540 | 56 | 71 | 1 | 10 | 37.4 | 2.22 | 0.139 |
| Example 2 | — | 57 | 70 | <1 | <10 | 37.0 | 2.31 | 0.084 |
| Example 3 | 540 | 57 | 70 | 1 | 10 | 36.9 | 2.32 | 0.088 |
| Example 4 | 540 | 56 | 68 | 1 | 12 | 37.3 | 2.36 | 0.082 |
| Example 5 | 540 | 45 | 60 | 1 | 10 | 36.7 | 2.29 | 0.182 |
| Example 6 | 540 | 52 | 67 | 1 | 10 | 36.7 | 2.31 | 0.116 |
| Example 7 | 540 | 59 | 70 | <1 | <10 | 37.7 | 2.34 | 0.076 |

TABLE 3-continued

| | Surface Oxidation | Saturation Magnetization | | | | Volume-Average | | |
|---|---|---|---|---|---|---|---|---|
| | Treatment Temperature (° C.) | (B—H@0.5k · 1000/4π) (Am2/kg) | (B—H@3k · 1000/4π) (Am2/kg) | Residual Magnetization ($Am^2$/kg) | Coercive Force (1000/4π · A/m) | Particle Diameter (μm) | Apparent Density (g/$cm^3$) | BET Specific Surface Area ($m^2$/g) |
| Example 8 | 540 | 59 | 70 | <1 | <10 | 39.4 | 2.36 | 0.058 |
| Example 9 | 500 | 57 | 71 | <1 | <10 | 37.2 | 2.35 | 0.082 |
| Example 10 | 600 | 54 | 68 | 1 | 10 | 37.6 | 2.38 | 0.089 |
| Example 11 | 540 | 62 | 74 | 1 | 10 | 37.1 | 2.35 | 0.084 |
| Example 12 | 540 | 45 | 59 | 1 | 10 | 37.0 | 2.29 | 0.088 |
| Example 13 | 540 | 49 | 64 | 1 | 10 | 37.1 | 2.33 | 0.116 |
| Example 14 | 540 | 61 | 73 | 1 | 10 | 37.6 | 2.38 | 0.082 |
| Example 15 | 540 | 55 | 68 | 3 | 18 | 37.6 | 2.35 | 0.080 |
| Comparative Example 1 | 540 | 53 | 70 | 2 | 12 | 37.4 | 2.26 | 0.155 |
| Comparative Example 2 | 540 | 62 | 75 | 1 | 10 | 38.6 | 2.40 | 0.069 |
| Comparative Example 3 | 540 | 44 | 58 | 1 | 10 | 38.3 | 2.41 | 0.079 |
| Comparative Example 4 | 540 | 40 | 52 | 1 | 10 | 37.9 | 2.29 | 0.097 |
| Comparative Example 5 | 540 | 63 | 74 | 1 | 10 | 38.2 | 2.38 | 0.078 |
| Comparative Example 6 | — | 63 | 94 | 1 | 10 | 100.6 | 2.38 | 0.020 |
| Comparative Example 7 | 630 | 43 | 68 | 3 | 18 | 38.4 | 2.45 | 0.088 |

TABLE 4

| | Charging Properties (after Surface Oxidation Treatment) | | | | | Chemical Analyses (ICP) after Surface Oxidation Treatment (wt %) | | | | | |
|---|---|---|---|---|---|---|---|---|---|---|---|
| | L/L Charge Amount (μC/g) | N/N Charge Amount (μC/g) | H/H Charge Amount (μC/g) | (L/L Charge Amount)/(H/H Charge Amount) | N/N Resistance 2 mm-Gap (after Surface Oxidation Treatment) 50 V (Ω) | Fe | Ti | Mg | Sr | Mn | O and Accompanying Impurities |
| Example 1 | 50.54 | 48.26 | 45.88 | 1.10 | $5.9 \times 10^7$ | 50.60 | 0.46 | 2.14 | 0.50 | 19.12 | balance |
| Example 2 | 55.89 | 56.26 | 57.71 | 0.97 | $7.2 \times 10^7$ | 50.58 | 0.96 | 2.13 | 0.54 | 18.55 | balance |
| Example 3 | 56.71 | 53.40 | 58.56 | 0.97 | $1.6 \times 10^8$ | 50.63 | 0.93 | 2.12 | 0.55 | 18.52 | balance |
| Example 4 | 50.56 | 55.33 | 56.41 | 0.90 | $1.5 \times 10^8$ | 49.64 | 1.39 | 2.10 | 0.49 | 18.70 | balance |
| Example 5 | 17.94 | 18.16 | 19.33 | 0.93 | $2.0 \times 10^8$ | 50.22 | 1.03 | 2.22 | 0.56 | 19.13 | balance |
| Example 6 | 52.08 | 52.11 | 54.69 | 0.95 | $1.9 \times 10^8$ | 50.36 | 0.98 | 2.18 | 0.56 | 18.99 | balance |
| Example 7 | 56.28 | 58.87 | 60.03 | 0.94 | $2.3 \times 10^8$ | 50.46 | 0.92 | 2.08 | 0.48 | 18.50 | balance |
| Example 8 | 55.76 | 60.23 | 60.65 | 0.92 | $2.6 \times 10^8$ | 50.67 | 0.89 | 2.05 | 0.46 | 18.60 | balance |
| Example 9 | 55.50 | 56.48 | 55.87 | 0.99 | $6.0 \times 10^7$ | 50.22 | 0.92 | 2.13 | 0.57 | 18.83 | balance |
| Example 10 | 55.55 | 53.37 | 60.17 | 0.92 | $2.6 \times 10^7$ | 50.29 | 0.93 | 2.09 | 0.58 | 18.64 | balance |
| Example 11 | 55.46 | 55.66 | 55.84 | 0.99 | $1.0 \times 10^7$ | 50.96 | 0.95 | 1.40 | 0.56 | 19.08 | balance |
| Example 12 | 52.67 | 53.09 | 53.12 | 0.99 | $1.2 \times 10^9$ | 50.76 | 0.93 | 2.57 | 0.54 | 18.37 | balance |
| Example 13 | 50.92 | 50.83 | 50.82 | 1.00 | $1.2 \times 10^7$ | 52.65 | 1.04 | 2.23 | 0.59 | 14.22 | balance |
| Example 14 | 55.77 | 57.86 | 58.96 | 0.95 | $2.0 \times 10^9$ | 44.87 | 0.84 | 1.91 | 0.44 | 24.67 | balance |
| Example 15 | 52.92 | 53.40 | 54.26 | 0.98 | $1.8 \times 10^8$ | 51.02 | 0.93 | 2.10 | 0 | 18.54 | balance |
| Comparative Example 1 | 39.87 | 37.56 | 32.71 | 1.22 | $9.0 \times 10^7$ | 51.03 | 0 | 2.16 | 0.53 | 18.62 | balance |
| Comparative Example 2 | 57.68 | 56.96 | 47.61 | 1.21 | $1.0 \times 10^8$ | 51.18 | 0 | 2.14 | 0.56 | 18.69 | balance |
| Comparative Example 3 | 54.86 | 54.89 | 55.00 | 1.00 | $2.0 \times 10^8$ | 50.16 | 1.81 | 2.03 | 0.55 | 17.78 | balance |
| Comparative Example 4 | 51.86 | 52.16 | 52.24 | 0.99 | $3.4 \times 10^9$ | 49.88 | 0.94 | 3.17 | 0.55 | 17.35 | balance |
| Comparative Example 5 | 50.46 | 50.66 | 51.23 | 0.98 | $8.8 \times 10^{10}$ | 40.16 | 0.77 | 1.68 | 0.40 | 30.13 | balance |
| Comparative Example 6 | 11.23 | 10.83 | 11.34 | 0.99 | $2.7 \times 10^5$ | 58.66 | 0.06 | 0 | 0 | 13.28 | balance |
| Comparative Example 7 | 58.83 | 58.71 | 58.69 | 1.00 | $1.9 \times 10^9$ | 63.21 | 1.45 | 1.74 | 0.78 | 4.23 | balance |

As is clear from the results in Tables 3 and 4, since the ferrite carrier core materials of Example 1 to 15 had a desired resistance and magnetization, and were excellent in the charging properties, developers excellent in the durability and the like were obtained.

By contrast, since the ferrite carrier core material of Comparative Example 1 contained no Ti added, the core material exhibited not only a large BET specific surface area, and a low charge amount, but also a large environmental difference. In the ferrite carrier core material of Comparative Example 2, although making the sintering temperature high made the BET specific surface area small, and the charge amount in N/N was large, the environmental difference was not improved. The ferrite carrier core materials of Comparative Examples 3 and 4 had a low magnetization, and caused the carrier beads carry over when the core material and coated carrier were made into a developer. Since the ferrite carrier core material of Comparative Example 5 had a high resistance, the edge became too sharp, thereby reducing the image quality. The ferrite carrier core material of Comparative Example 6 was amorphous, and had a very small BET specific surface area, a large SF-2 and a low charge amount and resistance as well. Thereby, when the core material was made into a developer, the image quality deteriorated including the occurrence of fogging and a deterioration of gradation. Since the ferrite carrier core material of Comparative Example 7 had a low magnetization at a low magnetic field, the carrier beads carry over is caused when made into a developer.

Example 16

A carrier core material particle having an average particle diameter of 56.9 μm was fabricated by the same method as in Example 3, and coated with an acryl-modified silicone resin KR-9706, made by Shin-Etsu Silicones Co., Ltd., as a coating resin by a fluidized bed coating apparatus. At this time, the resin solution used was prepared such that the resin was weighed so that the amount of the resin was 0.75% by weight in terms of solid content with respect to the carrier core material, and a mixed solvent of toluene and MEK in 3:1 in weight ratio was added so that the solid content of the resin was 10% by weight. After the resin coating, the particle was dried under stirring for 3 hours in a heat exchange-type stirring/heating apparatus set at 200° C. to remove completely volatile components, to obtain a resin-coated carrier.

Example 17

A carrier core material particle having an average particle diameter of 56.9 μm was fabricated by the same method as in Example 3, and coated with a mixture of a silicone resin KR-350, made by Shin-Etsu Silicones Co., Ltd., an aluminum-based catalyst CAT-AC, made by Dow Corning Toray Co., Ltd., an aminosilane coupling agent KBM-603, made by Shin-Etsu Silicones Co., Ltd., and Ketjen Black EC600JD, made by Lion Corp., as a coating resin by a fluidized bed coating apparatus. At this time, the resin solution used was prepared such that the silicone resin KR-350 was weighed so that the amount of the resin was 1.5% by weight in terms of solid content with respect to the carrier core material, that 2% by weight of the aluminum-based catalyst CAT-AC, 10% by weight of the aminosilane coupling agent KBM-603 and 10% by weight of the Ketjen Black EC600JD with respect to the solid content of the resin were added to the resin, and further that toluene was added so that the solid content of the resin was 10% by weight, and the mixture was pre-dispersed for 3 min by a homogenizer T65D ULTRA-TURRAX, made by IKA-Werke GmbH & Co. KG, and thereafter subjected to a dispersing treatment for 5 min by a vertical-type bead mill to make the resin solution. After the resin coating, the particle was dried for 3 hours in a hot-air drier set at 250° C. to remove completely volatile components, to obtain a resin-coated carrier.

Example 18

A carrier core material particle having an average particle diameter of 56.9 μm was fabricated by the same method as in Example 3, and coated with an acrylic resin Dianal BR-80, made by Mitsubishi Rayon Co., Ltd., as a coating resin by a universal mixing stirrer. At this time, the resin solution used was prepared such that the resin was weighed so that the amount of the resin was 1.2% by weight in terms of solid content with respect to the carrier core material, and toluene was added so that the solid content of the resin was 10% by weight. Since the resin was a powder, the resin solution was put and heated in hot water up to 50° C. to completely dissolve the resin powder. After the resin coating, the particle was dried for 2 hours in a hot-air drier set at 145° C. to remove completely volatile components, to obtain a resin-coated carrier.

For Examples 16 to 18, the measurement results of the charge amounts after the resin coating are shown in Table 5. The measurement method of the charge amount was described before.

TABLE 5

| | Coating Resin | Coating Amount (wt %) | L/L Charge Amount (μC/g) | N/N Charge Amount (μC/g) | H/H Charge Amount (μC/g) |
|---|---|---|---|---|---|
| Example 16 | Acryl-modified silicone resin | 0.8 | 55.4 | 52.3 | 51.5 |
| Example 17 | Silicone resin | 1.5 | 50.4 | 47.5 | 46.8 |
| Example 18 | Acrylic resin | 1.2 | 54.6 | 51.4 | 50.6 |

As is clear from the results in Table 5, Examples 16 to 18 in which the ferrite carrier core materials according to the present invention were coated with the corresponding resin provided ferrite carriers for an electrophotographic developer having sufficient charging properties.

The ferrite carrier core material for an electrophotographic developer according to the present invention has a reasonable resistance and magnetization, and excellent charging properties, and a good environmental dependency because the core material can maintain a high charge particularly at a high-temperature and high-humidity. An electrophotographic developer composed of a ferrite carrier obtained by coating the ferrite carrier core material with a resin, and a toner has a high charge amount, and an excellent charging stability in every environment.

Therefore, the present invention can be used broadly in the fields of full-color machines especially requiring a high image quality, and high-speed machines requiring the reliability and the durability in image maintenance.

What is claimed is:

1. A ferrite carrier core material for an electrophotographic developer, comprising 13 to 27% by weight of Mn, 1.0 to 3.0% by weight of Mg, 0.3 to 1.5% by weight of Ti and 42 to 58% by weight of Fe.

2. The ferrite carrier core material for an electrophotographic developer according to claim 1, wherein the ferrite carrier core material has a magnetization of 45 to 70 $Am^2/kg$ at an impressed magnetic field of 0.5 $K \cdot 1000/4\pi$ A/m.

3. The ferrite carrier core material for an electrophotographic developer according to claim 1, wherein the ferrite carrier core material has a volume resistance of $1\times10^6$ to $1\times10^{10}\Omega$ at a 2 mm-Gap applied voltage of 50 V.

4. The ferrite carrier core material for an electrophotographic developer according to claim 1, wherein the ferrite carrier core material has a BET specific surface area of 0.060 to 0.170 $m^2/g$.

5. The ferrite carrier core material for an electrophotographic developer according to claim 1, wherein the ferrite carrier core material has a ratio of a charge amount in a low-temperature and low-humidity environment to a charge amount in a high-temperature and high-humidity environment of 0.85 to 1.15.

6. The ferrite carrier core material for an electrophotographic developer according to claim 1, comprising 0.1 to 1.0% of Sr.

7. The ferrite carrier core material for an electrophotographic developer according to claim 1, wherein the ferrite carrier core material has an oxide film formed on a surface thereof.

8. A ferrite carrier for an electrophotographic developer, being obtained by coating a surface of a ferrite carrier core material according to claim 1 with a resin.

9. An electrophotographic developer, comprising a ferrite carrier according to claim 8 and a toner.

10. The electrophotographic developer according to claim 9, being used as a refill developer.

* * * * *